United States Patent [19]

Schnebel, deceased et al.

[11] 4,021,987

[45] May 10, 1977

[54] TIE BEAMS AND GIRDERS FOR FACADES

[76] Inventors: Fritz Schnebel, deceased, late of Greimelberg, Germany; by Elfriede Johanna Schnebel, inheritor, 8201 Greimelberg 4, Germany; Johann Staber, Favoritenstrasse 7, Vienna, Austria

[22] Filed: July 16, 1975

[21] Appl. No.: 596,535

[52] U.S. Cl. ..... 52/495; 52/235; 52/725; 52/731

[51] Int. Cl.[2] ..... E04B 2/88

[58] Field of Search ..... 52/235, 495, 501, 731, 52/724, 725, 727

[56] References Cited

UNITED STATES PATENTS

| | | | |
|---|---|---|---|
| 2,949,981 | 8/1960 | Ferrell | 52/235 |
| 2,976,970 | 3/1961 | Toney | 52/235 |
| 3,102,617 | 9/1963 | Helfman | 52/727 |
| 3,736,717 | 6/1973 | Farley | 52/235 |
| 3,867,799 | 2/1975 | Pryor | 52/235 |

FOREIGN PATENTS OR APPLICATIONS

| | | | |
|---|---|---|---|
| 229,350 | 9/1956 | Australia | 52/235 |
| 1,242,995 | 8/1960 | France | 52/235 |
| 380,341 | 9/1964 | Switzerland | 52/235 |
| 1,277,891 | 6/1972 | United Kingdom | 52/235 |
| 913,773 | 12/1962 | United Kingdom | 52/235 |

*Primary Examiner*—Price C. Faw, Jr.
*Assistant Examiner*—Henry Raduazo
*Attorney, Agent, or Firm*—Sughrue, Rothwell, Mion, Zinn & Macpeak

[57] ABSTRACT

A tie beam or girder assembly for exterior building face construction includes a core formed by resiliently joined aluminum sections 1, 2, an intermediate layer of fire-resistant material 13, 23, 29, and a surrounding outer facing 14, 16, 20, 28 of steel plate. Resilient mounting strips 10, 11 are provided for securing windows 7 or facing panels 27 to the assembly between flanges 8, 9 extending from the sections and gripping strips 12.

7 Claims, 2 Drawing Figures

TIE BEAMS AND GIRDERS FOR FACADES

BACKGROUND OF THE INVENTION

1. Field of the Invention

The present invention relates to tie beams and girders comprising a core section and a facing intended for facade walls constructed from prefabricated parts and consisting of at least two tie beams or girder sections which are displaceable with respect to each other and which are covered on all sides with steel plate facing.

2. Description of the Prior Art

In the case of known tie beams and girders of this type—which are also known as stay beams or horizontal sections—it is common practice to use a supporting steel core piece covered with aluminum sheeting or the like. In practice, it is not possible to construct a steel core section of this type in such a way that panels, panes of glass and the like can be mounted directly on the steel core section by simply attaching a retaining strip and interposing packing elements, as a piece having the requisite preformed elements incorporated therein for receiving and supporting packing elements cannot be produced from steel, at least, in an economically viable manner. It is also difficult to produce multipart steel core pieces for tie beams and girders which are capable of absorbing horizontal or vertical compensating movements of the facade.

The requirements which must be satisfied by structural parts, particularly in multi-storey construction, are becoming increasingly stringent. For example, for load-bearing components such as tie beams and girders, the fire resistance class F90 according to DIN 4102 is applicable. In other words, fire-resisting tie beams and girders must be employed. This means that when one side of the structural part is exposed to the influence of a temperature of 1000° C for a period of at least 90 minutes, the temperature on the other side of the material should not be more than 140° above its initial temperature and at none of the measuring points should it be more than 180° above its initial temperature. In the case of panes of glass for a facade, a glass is currently being developed which will provide for an F30 fire-resistance class, and possibly an even higher class according to DIN 4102, for the glass elements per se. This means that even the glass elements are fire-resisting, i.e., fire-retardant, for a period of 30 minutes, whereas these elements were previously only considered to be fire-resisting for a period of at least 3 minutes.

The increasingly stringent fire resistance requirements placed on tie beams and girders could only previously be met by tie beams and girders comprising steel core pieces. However, a steel core piece cannot be used for facades which are to be produced in an economical and reliable manner for the reasons indicated above. An aluminum core piece which will enable the cross-section of this core piece to be constructed in a simple and economical manner in the desired and necessary form for panels, panes of glass and the like to be mounted directly thereon can only be used if special measures are adopted to comply with the fire resistance requirements for tie beams and girders.

SUMMARY OF THE INVENTION

The object of the present invention is therefore to produce tie beams and girders for use in facades constructed from prefabricated elements which comprise a core piece and a facing and which not only completely satisfy the fire resistance requirements for structural components of this type but which can also be constructed in a simple, economical and reliable manner in such a way that the panels, panes of glass and similar elements of the facade can be directly mounted thereon simply by attaching a retaining strip and interposing packing elements. In addition, the tie beams and girders should also be capable of absorbing the horizontal or vertical displacements of the facade within a specific tolerance range.

According to the invention this object is achieved in that the load bearing tie beams or girder sections are constructed of aluminum, are sealed with respect to each other and comprise pre-formed and pre-positioned elements for receiving the packing elements for panels, panes of glass and the like and in that the overall steel plate facing is provided on its inner side with a fire-resisting material and thus forms a fire-protective layer for the aluminum tie beam or girder sections.

By virtue of the fact that the pair of aluminum tie beam or girder sections are covered with insulating, fire-resisting material with a steel plate facing thereabove, the core piece can be made of aluminum which can easily be structured in such a way that panels, panes of glass and the like can be mounted on and retained directly by the tie beam or girder sections simply by attaching a retaining strip and interposing sealing elements. By dividing the core section into two tie beam or girder sections which are displaceable with respect to each other, any horizontal or vertical movements of the facade can be compensated by the tie beam or girder per se.

The steel plate facing on the outer side of the facade is advantageously secured by means of packing elements in appropriately retaining elements performed on one or both of the tie beam or girder sections in such a way that the tie beams or girder sections are displaceable with respect to the facing without damaging the facing or rendering it ineffective. An asbestos layer is advantageously disposed in the space between the tie beam or girder section and the steel plate facing.

The steel plate facing on the inner side of the facade is advantageously connected with the tie beam or girder sections by way of a snap connection. In a preferred embodiment, a snap connection of this type is present between the facing and the reinforcing parts of packing strips for panels, panes of glass and the like which are in contact with the tie beam or girder pieces.

The space between the steel plate facing on the inner side of the facade and the tie rod or girder sections preferably has a U-shaped cross-section and is provided with an inseparable fire-resisting material. If the tie beam or girder is used with contiguous panels, the fire-resisting material in the space is advantageously disposed in such a way that it overlaps the fire-resisting material of the panels.

Other objects, features and advantages of the present invention will be made apparent in the following detailed description of a preferred embodiment thereof provided with reference to the accompanying drawings.

DESCRIPTION OF THE PREFERRED EMBODIMENT

Figure 1:
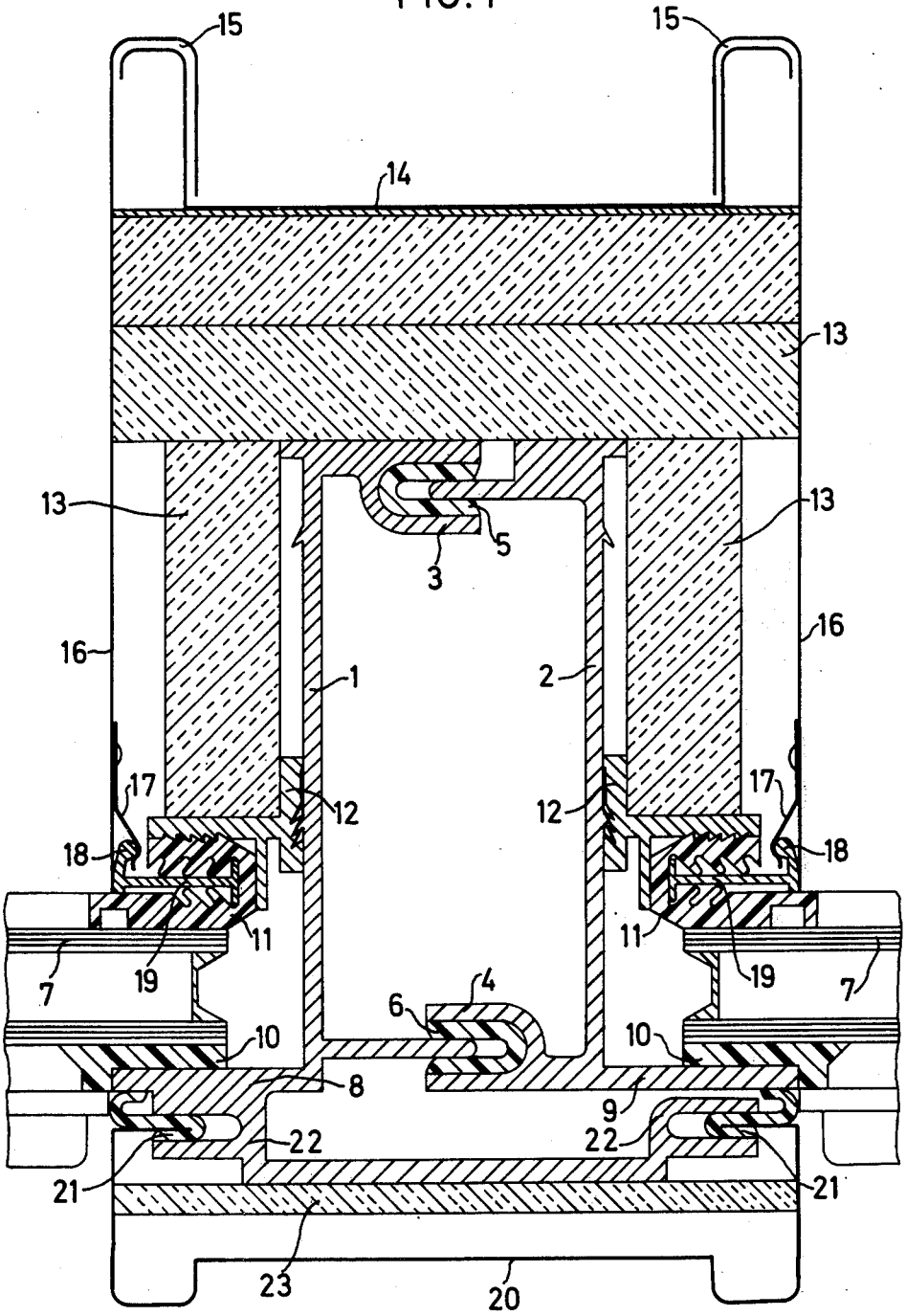
FIG. 1 is a cross-sectional view through a tie beam according to the invention with adjoining panes of glass.

The embodiments of the invention represented in the drawings consist of tie beams. Apart from differences resulting from their function, the essential parts of girders constructed according to the invention correspond to those of the tie beams represented in the drawings.

FIG. 1 shows a horizontal section through a tie beam according to the invention which is intended for facade walls constructed from prefabricated elements. The tie beam comprises a core section which consists of two aluminum tie beam sections 1 and 2. The tie beam sections 1 and 2 are joined together at points 3 and 4 with permanently flexible packings 5 and 6 interposed therebetween in such a way that they are horizontally displaceable with respect to each other. In this way, the core section consisting of the two tie beam sections 1 and 2 is capable of absorbing horizontal tolerance movements of the facade.

Panes of glass 7 consisting of double glass panes are mounted in an appropriate holder on the side of the tie beam directed towards the outer side of the facade. The holder for the pane of glass 7 is constructed in the manner described hereinafter. On one side of the pane of glass 7 the tie beam section 1 or 2 is provided with an arm piece 8 or 9 projecting parallel to the plane of the facade. The pane of glass 7 rests against the piece 8 or 9 with a permanently flexible packing element 10 interposed therebetween. A packing strip 11 consisting of permanently flexible material rests against the opposite face of the pane of glass 7. The packing strip 11 is pressed against the pane of glass 7 by means of a glass gripping strip 12 in such a way that a predetermined pressure is exerted on the pane of glass 7. The glass gripping strip 12 is secured without bolts to its respective tie beam section 1 or 2 in the manner illustrated.

On the inner side of the facade the joined tie beam sections 1 and 2 are covered with an insulating and fire-resistant material 13, for example, Thermax. The insulating, fire resistant-material 13 extends in a U-shaped manner from the glass gripping strip 12 on the tie beam section 1 to the glass gripping strip 12 on the tie beam section 2. The fire-resistant material is, in turn, enclosed in an essentially U-shaped steel plate facing 14. The facing 14 can, in turn, consist of three parts: two parts 16 extending vertically with respect to the facade and a part extending parallel to the facade. The parts 16 extending vertically with respect to the facade may possibly overlap the part extending parallel to the facade, for example, in the manner of a U-shaped connection 15. The parts 16 of the facing 14 extending vertically with respect to the facade are advantageously connected with the tie beam sections 1 and 2 by means of snap connections 17. The snap connections preferably engage in lugs 18 which are, in turn, preformed in reinforcing parts 19 of the packing strips 11. In this way, the outer side of the tie beam is completely covered with the steel plate facing 14 from one pane of glass to the next.

A steel plate facing 20 is also provided on the outer side of the core section consisting of the tie beam core sections 1 and 2. This facing 20 is connected with the tie beam sections 1 and 2 via permanently flexible packings 21 in such a way that the tie beam sections 1 and 2 are capable of being displaced with respect to each other in a horizontal direction without impairing the operating efficiency of the facing 20. In the embodiment shown, the facing 20 is retained in two holder elements 22 comprising slit-form recesses directed parallel to the outer wall of the facade. The packings 21 also rest against the tie beam sections 1 or 2. An asbestos layer 23 extends over the entire width of the facing between the tie beam sections 1 and 2 and the facing 20.

Figure 2:
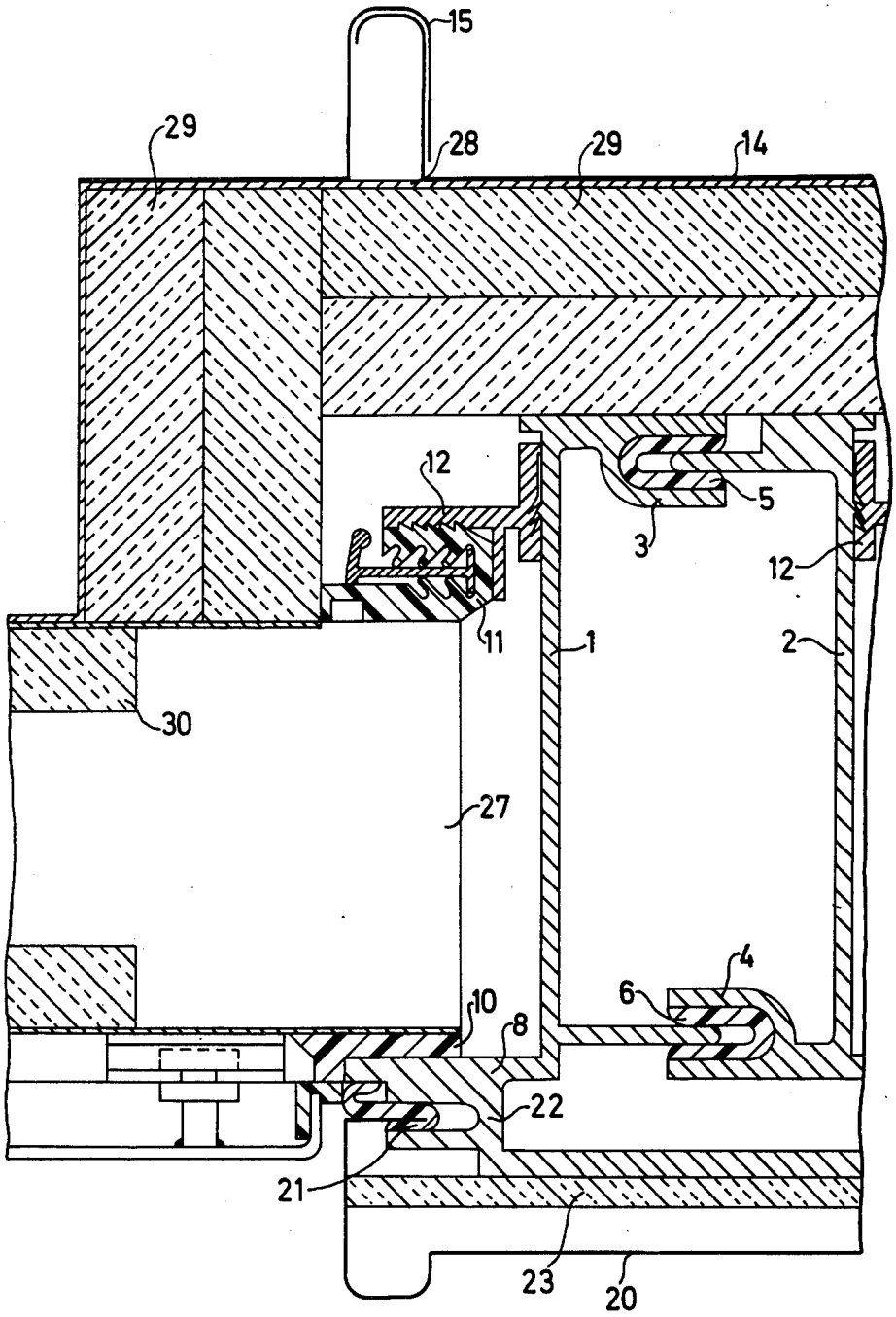
FIG. 2 is a partial sectional view through a tie beam according to the invention with an adjacent panel.

FIG. 2 shows a horizontal section through a tie beam according to the invention, adjoining which is a panel 27 in place of a pane of glass 7. The panel 27 is retained between a piece 8 of the tie beam 1 and a boltless glass gripping strip 12 with a packing 10 and a packing strip 11 interposed therebetween. In this embodiment a steel plate facing 28 which extends in a U-shaped manner from the panel 27 to the panel on the other side of the tie beam (not represented) is also provided on the inner side of the facade. The space between the core section consisting of the tie beam sections 1 and 2 and the inner facing 28 is provided with fire-resistant material 29 in such a way that the fire-resistant material 29 overlaps the fire-resistant material 30 contained in the panel 27. The structure and application of the outer facing 20 corresponds exactly to that of the embodiment shown in FIG. 1.

What is claimed is:

1. A tie beam assembly comprising:

a core section consisting of at least two tie beam sections, means for interfittingly connecting said sections together for displacement relative to each other, an inner steel plate facing, an outer steel plate facing and said steel plate facings covering all exposed surfaces of said tie beam sections, at least one preformed element and at least one integral element carried in spaced opposed fashion on at least one unexposed surface of said tie beam sections for mounting panels, panes of glass and the like on at least one side of said tie beam assembly, said tie beam sections being formed of aluminum, means for sealing said tie beam sections together at said interfitting means, and a fire-resistant material provided on the inner side of said steel plate facings and acting as a fire protective means for the aluminum tie beam sections.

2. A tie beam assembly as claimed in claim 1, wherein retaining elements provided on at least one of the tie beam sections and an interposed packing retains the outer steel plate facing mounted to said at least one tie beam section.

3. A tie beam assembly as claimed in claim 2, characterized in that the fire-resistant material provided between the tie beam sections (1, 2) and the steel plate facing comprises an asbestos layer.

4. A tie beam assembly as claimed in claim 1, wherein a snap connection connects the side steel plates facing with respective tie beam sections.

5. A tie beam assembly as claimed in claim 4, further comprising packing strips carried by said preformed elements for mounting said panes of glass and the like, and wherein reinforcing pieces are mounted to the packing strips for joining the side steel facing to the tie beam sections and comprise portions of said snap connections.

6. A tie beam assembly as claimed in claim 1, wherein the fire-resistant material provided between the inner and side steel plates and the tie beam sections are of U-shaped cross-section.

7. A tie beam assembly as claimed in claim 6, wherein said opposing, preformed and integral elements support a panel which is coupled to one side of said interfitting tie beam sections, and wherein fire-resistant material is provided on said panels with the fire-resistant material of U-shaped cross-section interposed between the inner steel plate and the side steel plate overlapping that provided on said panels.

* * * * *